US008539915B2

(12) United States Patent
Baumann et al.

(10) Patent No.: US 8,539,915 B2
(45) Date of Patent: Sep. 24, 2013

(54) COOLING SYSTEM FOR A MOTOR VEHICLE

(75) Inventors: Michael Baumann, Ammerbuch (DE); Günther Beez, Masserberg (DE); Holger Conrad, Veilsdorf (DE); Oliver Gebhardt, Sonneberg (DE); Rüdiger Knauβ, Kerner I.r. (DE)

(73) Assignee: Mahle International GmbH (DE)

( * ) Notice: Subject to any disclaimer, the term of this patent is extended or adjusted under 35 U.S.C. 154(b) by 660 days.

(21) Appl. No.: 12/700,343

(22) Filed: Feb. 4, 2010

(65) Prior Publication Data

US 2010/0206250 A1 Aug. 19, 2010

(30) Foreign Application Priority Data

Feb. 5, 2009 (DE) ..... 10 2009 007 695

(51) Int. Cl.
*F01P 7/14* (2006.01)

(52) U.S. Cl.
USPC ..... 123/41.09

(58) Field of Classification Search
USPC ..... 123/41.01, 41.08, 41.09; 137/625.41, 137/625.46, 625.69, 625.27, 625.67, 625.48, 137/896–898, 861, 862, 607
See application file for complete search history.

(56) References Cited

U.S. PATENT DOCUMENTS 4,425,878 A * 1/1984 Samuel ..... 123/41.08
5,927,257 A * 7/1999 Hackett ..... 123/568.26
6,516,755 B2 * 2/2003 Gregory ..... 123/41.1
6,745,995 B2 * 6/2004 Hu et al. ..... 251/81
2003/0136357 A1 * 7/2003 Kobayashi et al. ..... 123/41.08
2004/0211373 A1 * 10/2004 Norris ..... 123/41.1

FOREIGN PATENT DOCUMENTS

DE 19524424 A1 1/1996
DE 10155337 A1 5/2003
DE 102005057702 A1 6/2007
JP 05263642 A * 10/1993

OTHER PUBLICATIONS

English abstract provided for DE 10155337.
English abstracts provided for DE 102005057702.
English abstract provided for DE 19524424.

* cited by examiner

*Primary Examiner* — Noah Kamen
*Assistant Examiner* — Hung Q Nguyen
(74) *Attorney, Agent, or Firm* — Rader, Fishman & Grauer PLLC

(57) ABSTRACT

A cooling system for motor vehicle with a cooling circuit, which includes one or more internal combustion engines, a pump and a cooling device, is described herein. The cooling system includes a short circuit line, which bypasses the pump by connecting a pressure side of the pump to an intake side of the pump. The cooling system further includes a valve device in the region of the short circuit line, and the valve device is switched between two or more positions. When the valve is in the first position, the entire coolant flow is directed through the short circuit line. Further, when the valve is in the second position, the entire coolant flow is directed through the internal combustion engine and not through the short circuit line.

23 Claims, 4 Drawing Sheets

COOLING SYSTEM FOR A MOTOR VEHICLE

CROSS-REFERENCES TO RELATED APPLICATIONS

This application claims priority to German patent application DE 10 2009 007 695.6 filed on Feb. 5, 2009, which is hereby incorporated by reference in its entirety.

TECHNICAL FIELD

The present invention relates to a cooling system in a motor vehicle with a cooling circuit in which at least one internal combustion engine, one pump and one cooling device are arranged.

BACKGROUND

Owing to steadily rising energy prices and increasingly stricter emission values, vehicle manufacturers are increasingly trying to reduce the energy consumption of their motor vehicles, in particular the energy consumption which is not directly used to drive the motor vehicle. This includes in particular energy consumption while idling as well as the energy consumption of various electrical consumers within the motor vehicle.

The present invention is concerned with the problem of creating a cooling system in a motor vehicle, which has a much lower energy requirement compared to previously known cooling systems.

This problem is solved according to the invention by the subject matter of the independent claim 1. Advantageous embodiments form the subject matter of the dependent claims.

The present invention is based on the general idea of, in a cooling system with a cooling circuit in which at least one consumer to be cooled, for example an internal combustion engine, one pump and one cooling device are arranged, connecting a pressure side and an intake side of the pump by means of a short circuit line, that is, by means of a bypass line, which is opened when cooling is not necessary and thereby conducts at least most of a coolant flow no longer through the internal combustion engine and the whole cooling circuit but diverts it into a short circuit with much less resistance. In order to divert or divide the coolant flow to the internal combustion engine or to the short circuit line which bypasses the pump, a valve device is used, which requires much reduced actuation forces owing to the short circuit line which is now present and thereby can be configured to be smaller and also more economical with regard to energy consumption. The valve device according to the invention is arranged in the region of the short circuit line, for example in the region of a branch of the short circuit line from the cooling circuit or in the region of a junction of the short circuit line into the cooling circuit. Furthermore, the valve device according to the invention can be switched between at least two positions, wherein in the first position at least most of the coolant flow flows through the short circuit line and in the second position at least most of the coolant flow flows through the internal combustion engine and not through the short circuit line. Any desired intermediate positions which allow any desired division of the coolant flow between the actual cooling circuit and the short circuit are of course also conceivable. If for example no cooling effect is needed in the internal combustion engine or another consumer to be cooled, the valve device can be moved into its first position and thereby the cooling medium can be pumped through the short circuit with comparatively low resistance. With the valve device according to the invention which is arranged in the region of the short circuit line, it is thus possible to control the cooling demand in the internal combustion engine and thus also the output of the coolant pump in a relatively flexible manner. If the internal combustion engine does not need cooling, the valve device is then simply moved into its first position so that at least most of the coolant flow flows through the short circuit line and no longer through the internal combustion engine or the cooling device.

SUMMARY

In an advantageous development of the solution according to the invention, the valve device is configured as a proportional valve. Compared to a valve device which can be switched to and from between only two positions, such a proportional valve has the great advantage that it can be switched into any desired intermediate positions, as a result of which a virtually freely selectable division of the coolant flow flowing through the internal combustion engine and the short circuit line is possible. This allows particularly precise control which prevents in particular the pressure peaks when switching between the two positions, which are typical for a valve which can be switched to and from between only two positions. Actuation of the valve device according to the invention can for example take place by means of an engine control unit which is present in any case and, in addition to the operating state of the internal combustion engine which occurs in each case, for example full load or partial load, also detects a temperature of the cooling medium.

Further important features and advantages of the invention can be found in the subclaims, the drawings and the associated description of the figures using the drawings.

It is self-evident that the features which are mentioned above and those which are still to be explained below can be used not only in the combination specified in each case, but also in other combinations or alone without departing from the framework of the present invention.

Preferred exemplary embodiments of the invention are shown in the drawings and are explained in more detail in the following description, with the same reference symbols referring to the same or similar or functionally identical components.

BRIEF DESCRIPTION OF THE DRAWING

In the figures.

DETAILED DESCRIPTION

Figure 1:
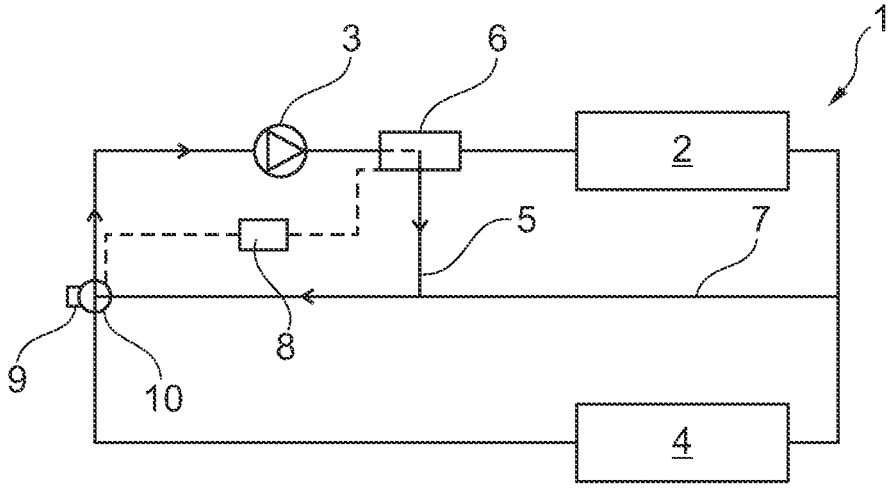
FIG. 1 to 5 schematically show different embodiments of a cooling system according to the invention, FIG. 6 schematically shows a possible embodiment of a valve device, FIG. 7 schematically shows a possible structure of a valve in the valve device, FIG. 8 schematically shows a sleeve valve for the valve device, FIG. 9 schematically shows a detail of the sleeve valve according to FIG. 8, FIG. 10*a,b* schematically show the sleeve valve in two different switched positions.
Figure 2:
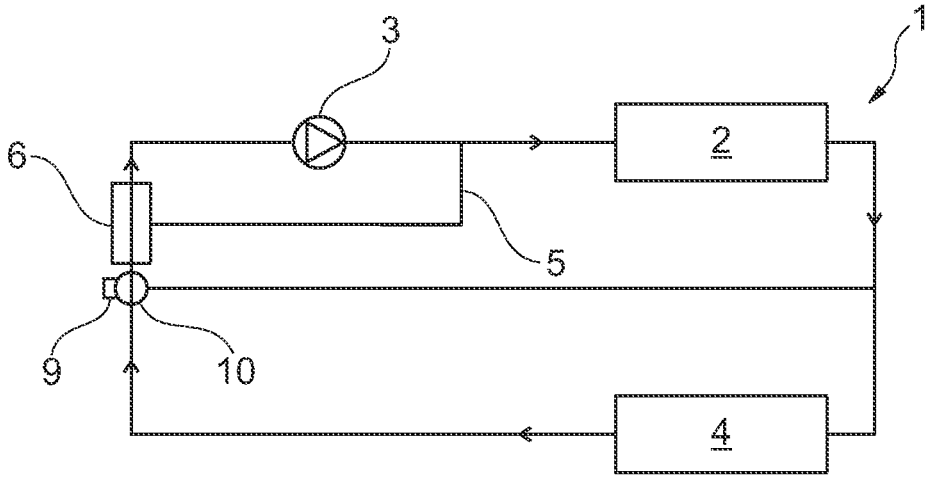
Figure 3:
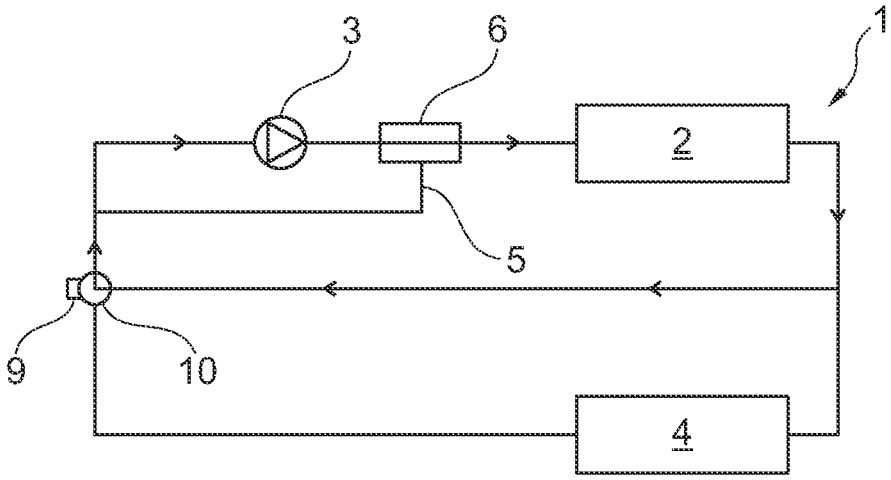
Figure 4:
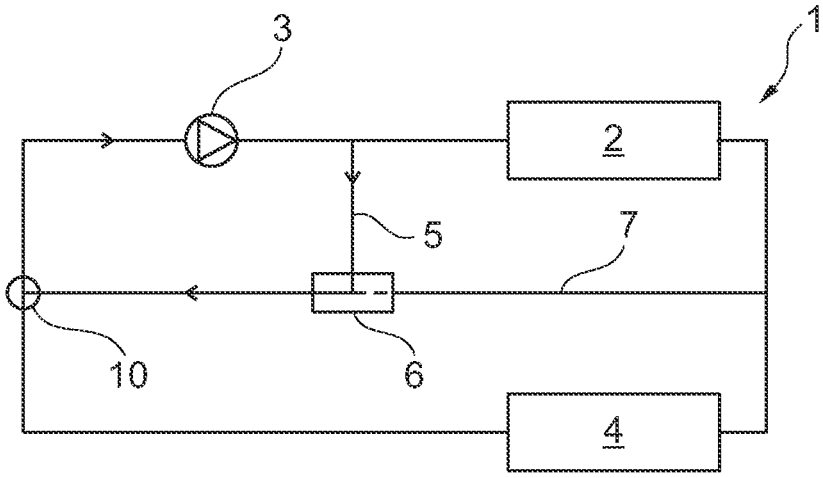

According to FIG. 1 to 5, a cooling system 1 according to the invention, which can be arranged for example in a motor vehicle, has a cooling circuit in which at least one internal combustion engine 2, one pump 3 and one cooling device 4 are arranged. According to the invention, a short circuit line 5 which bypasses the pump 3 is now provided, which connects a pressure side of the pump 3 with an intake side of the same. Furthermore, a valve device 6 which can be switched between at least two positions is provided in the region of the short circuit line 5, that is more precisely in the region of the branch of the same from the cooling circuit or in the region of the junction of the same into the cooling circuit or into a bypass line. The valve device 6 can be configured as what is known as a multiway valve, in particular as a 3-2-way valve, and in the first position as shown in FIGS. 1 and 4 can conduct at least most of the coolant flow, preferably the entire coolant flow, through the short circuit line 5, whereas in the second position as shown in FIGS. 2 and 3 it conducts at least most of the coolant flow, preferably the entire coolant flow, through the internal combustion engine 2 and not through the short circuit line 5. According to FIG. 1 to 5, the respective coolant flow is shown by corresponding flow arrows.

In general a bypass line 7 which bypasses the cooling device 4 can preferably be provided in the cooling system 1 according to the invention, with it being conceivable for the short circuit line 5 as shown in FIG. 1 also to open into the bypass line 7. With the valve device 6 according to the invention it is possible to switch over the same in particular in the event that the internal combustion engine 2 needs no or only a little cooling, as a result of which the coolant flow must be pumped exclusively or at least partially through the short circuit with much lower resistance, as shown in FIG. 1, so that in this case the pump 3 can be operated at a much lower output. The state shown in FIG. 1 is for example conceivable in the event of a cold start of the internal combustion engine 2, in which the latter does not have to be cooled, and should not be cooled as cooling of the same would be advantageous neither for driving comfort nor for emission of pollutants. Owing to the short circuit line 5 which is provided according to the invention, the valve device 6 needs much reduced actuation forces and can thereby be configured to be smaller and also more economical with regard to energy consumption. Without the presence of the short circuit line 5, much greater actuation forces would be necessary to switch the valve device 6, which means a higher energy demand. At the same time the valve device 6 itself would also have to be designed to be larger and therefore heavier, which likewise means an increased energy demand.

According to FIGS. 1 and 3-5, the valve device 6 according to the invention is arranged in the cooling circuit downstream of the pump 3, whereas it is arranged in the cooling circuit upstream of the same according to FIG. 2. The valve device 6 can for example be configured as a throttle device and/or be actuated pneumatically, electrically or hydraulically. An engine control unit 8 can in particular be used for actuation, which unit for example detects an operating state of the internal combustion engine 2, in particular a full load or partial load state, and/or a temperature of the cooling medium. For the sake of clarity this is only shown in FIG. 1, but can likewise also be present in the cooling systems 1 according to FIGS. 2 and 3. To this end, a thermostat 9 can be provided for example in the junction region of the bypass line 7 into the cooling circuit. Of course it is also conceivable for the valve device 6 to be configured as a poppet valve or as an annular slide valve, with the valve device 6 always being configured on the basis of a "fail-safe" principle in such a manner that it remains in its second position when in the inactive, that is, non-actuated state and thereby ensures sufficient cooling of the internal combustion engine 2 in every case. It is of course also conceivable for the valve device 6 according to the invention to be configured as a proportional valve, as a result of which any desired division of the coolant flow through the internal combustion engine 2 and the short circuit line 5 can be effected.

Figure 5:
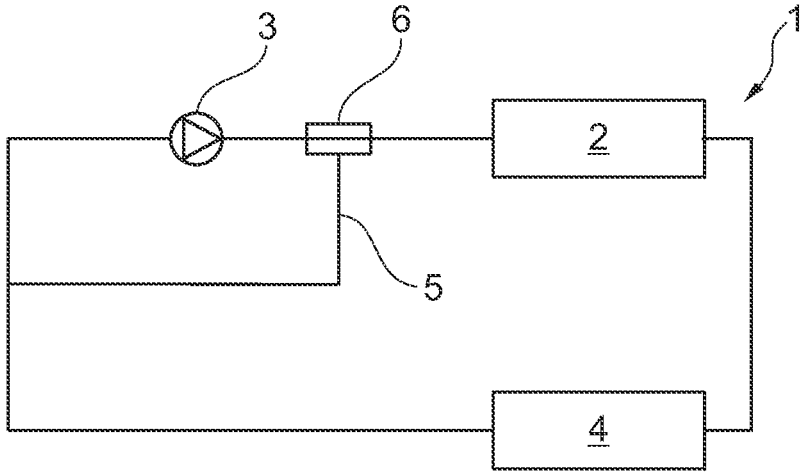

According to FIG. 4, the valve device 6 is arranged in the junction region of the short circuit line 5 into the bypass line 7, wherein in this case too at least most of the coolant flow flows through the short circuit line 5 when the valve device 6 is moved into its first position, as the said short circuit line has a much lower flow resistance compared to the cooling circuit which leads through the internal combustion engine 2 and the cooling device 4. The bypass line 7 is of course purely optional, so that this can also be omitted, as shown in FIG. 5.

In general the valve device 6 according to the invention allows the regulation of a volumetric flow in the cooling circuit through the internal combustion engine 2 with the possibility of reducing this volumetric flow to zero if necessary. If the valve device 6 is activated, the pump 3 conveys the cooling medium in the low-resistance short circuit and not through further consumers to be cooled such as the internal combustion engine 2. If in contrast a little cooling is needed in the internal combustion engine 2, the thermostat 9 or a valve device 10 coupled thereto can suppress a coolant flow through the cooling device 4 and conduct it through the bypass line 7 (cf. FIG. 3). If, on the other hand, the cooling effect of the cooling device 4 is needed, which can be determined for example by a correspondingly increased coolant temperature at the thermostat 9, the valve device 10 which is coupled to the thermostat 9 can be switched in such a manner that the coolant flow no longer flows through the bypass line 7 but rather through the cooling device 4 (cf. FIG. 2). The valve device 10 which is coupled to the thermostat 9 can be configured in the same manner as the valve device 6.

In general, at least three different cooling levels, namely no cooling (FIG. 1), low cooling (FIG. 3) and higher cooling (FIG. 2) can be set with the two valve devices 6 and 10. The configuration of the valve devices 6 and 10 as proportional valves means furthermore that any desired intermediate cooling levels can be set. A low activation force at least of the valve device 6 is possible thanks to the respective connection of the short circuit line 5 from the pressure side to the intake side of the pump 3. An intervention in the main coolant flow of the internal combustion engine 2 is likewise not necessary. In addition there is also the possibility of limiting the pressure of the coolant circuit within the valve device 6.

The cooling system 1 according to the invention has in principle the following advantages:

- reduction in the risk of cavitation in the pump 3 when intervening in the coolant flow,
- low switching force at least of the valve device 6,
- fast response,
- integrated parallel overpressure function,
- "fail safe" function
- integration into a cooling circuit at any point,
- low energy demand,
- rapid engine heating thanks to a corresponding switch of the valve device 6 into its second position.

Figure 6:
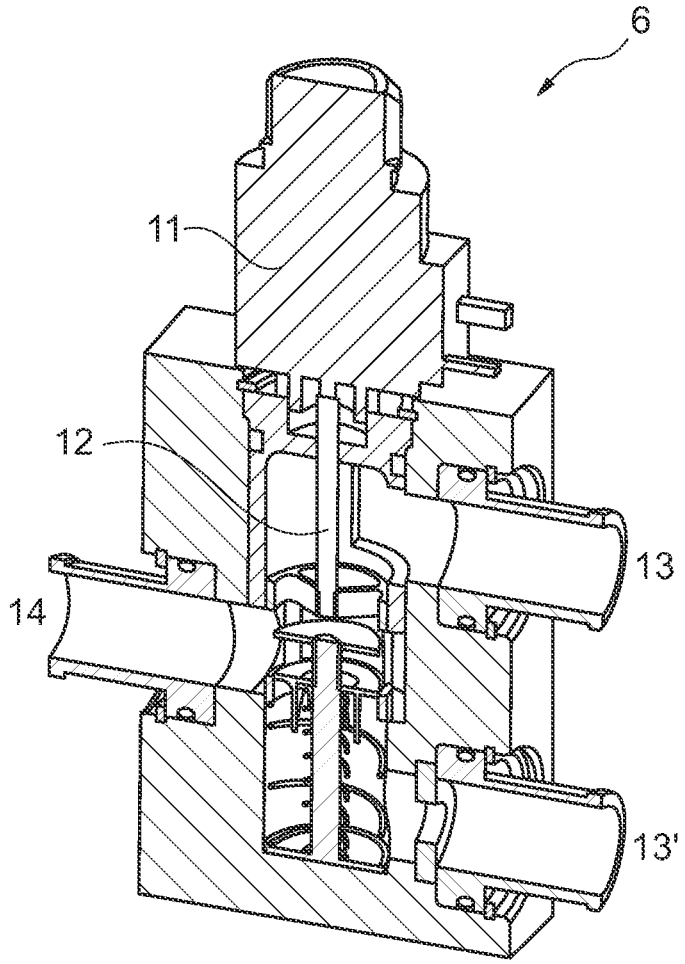

According to FIG. 6, a possible prototype of the valve device 6 is shown with a solenoid 11, which moves a valve tappet 12 by creating a magnetic field which is spatially as constant as possible. The valve device shown has two inlets 13, 13' and an outlet 14, as a result of which it is possible to mix the input flows as desired to form a common output flow.

Figure 7:
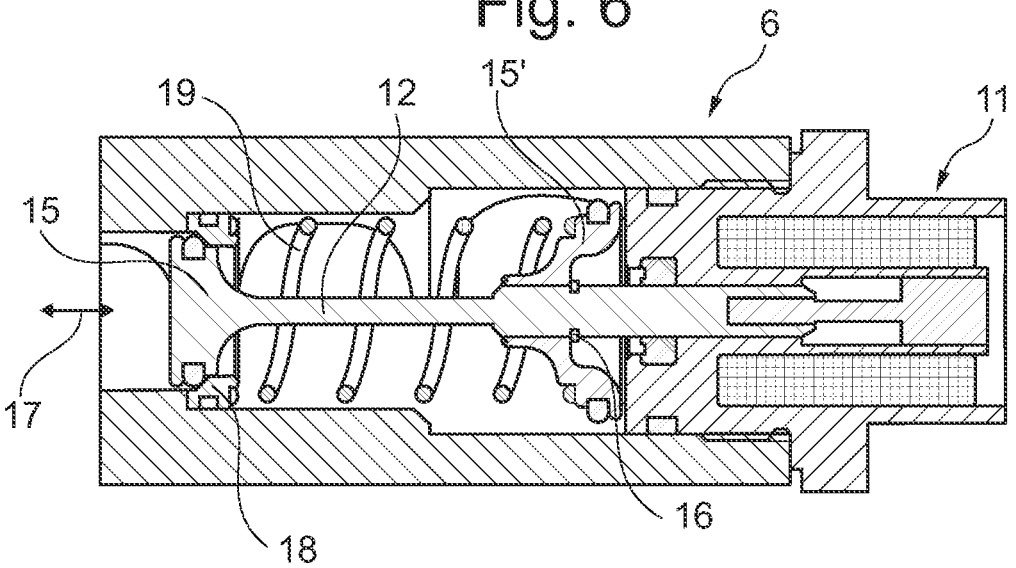

According to FIG. 7, the valve device 6 has two valve discs 15, 15' which are arranged on the valve tappet 12, with the valve disc 15 preferably being configured in one piece with the valve tappet 12. In the example shown the valve disc 15' is produced as a separate component and secured in the axial direction 17 on the valve tappet 12 by means of a securing element 16. A spring 19 is provided between the valve disc 15' and a valve seat ring 18, which spring preloads the valve disc 15 against the valve seat ring 18 and thus into its closed position. Such a configuration of the valve device 6 is suitable in particular for flow rates of <120 l/min, with only very low leakage flows being likely thanks to the good sealing effect.

Figure 8:
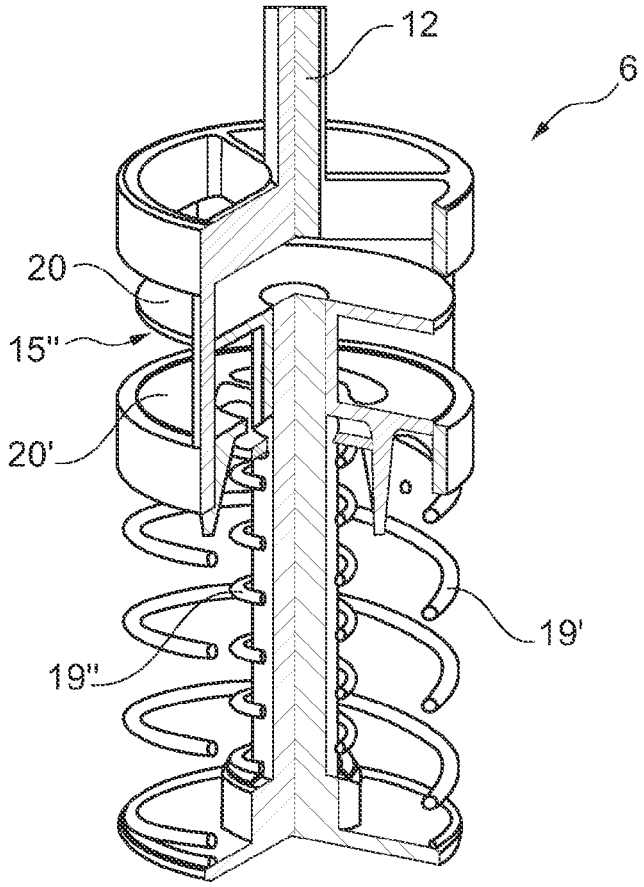
Figure 9:
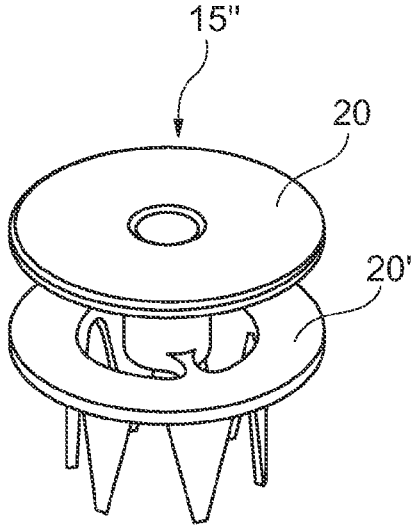
Figure 10:
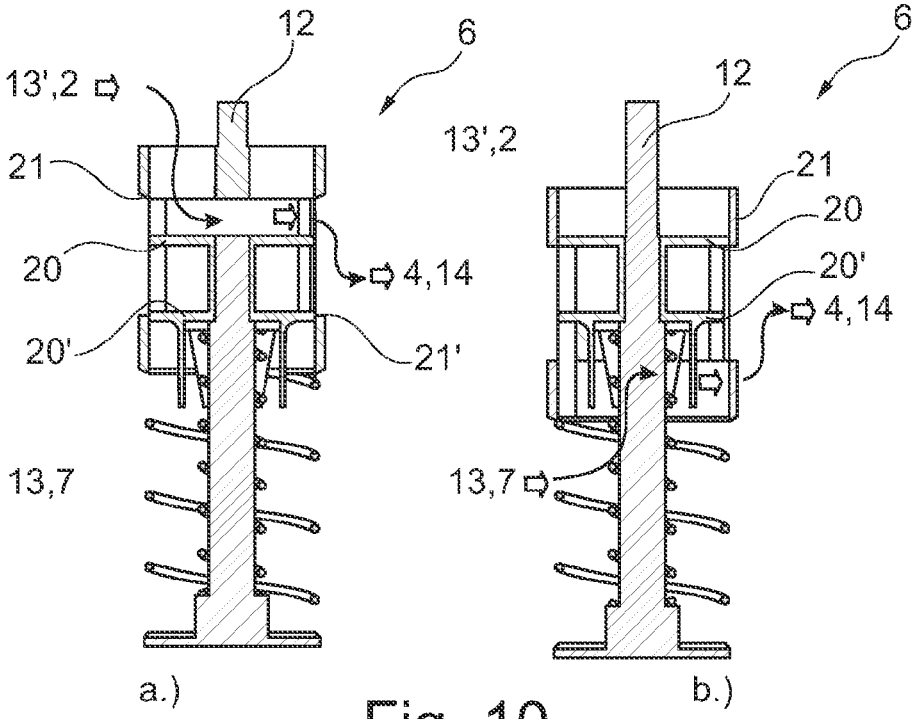

According to FIGS. 8 and 9, a further possible embodiment of the interior of the valve device 6 is shown. In this case a combined valve disc 15" and two springs 19' and 19" are provided. The spring 19' is configured as a safety spring, while an overpressure function can be ensured with the spring 19". The combined valve disc 15" has two valve plates 20 and 20' which bear closely against associated valve seats 21 and 21' depending on the switched position. FIGS. 10*a* and 10*b* show the two extreme switched positions of the valve device 6, with the bypass line 7 being closed in FIG. 10*a* and the bypass line 7 being open in FIG. 10*b*, as in for example a cold start. The individual parts of the valve device 6, in particular the valve discs 15, 15", can be formed from metal or plastic.

The invention claimed is:

1. A motor vehicle cooling system, comprising: a cooling circuit, wherein the cooling circuit includes at least one internal combustion engine, one pump and one cooling device;

a short circuit line, which bypasses the pump, wherein the short circuit line connects a pressure side of the pump to an intake side of the pump;

a valve device, which is switched between at least a first position and second position is provided in the region of the short circuit line, wherein switching the valve device to the first position directs at least most of a coolant flow through the short circuit line, and when switching the valve device to the second position the entire coolant flow is directed through the internal combustion engine bypassing the short circuit line;

wherein the valve device includes a valve tappet and two valve discs spaced apart in an axial direction on the valve tappet for directing the coolant flow;

wherein the valve discs are disposed on opposing ends of the valve tappet; and a spring disposed between one of the valve discs and a valve seat ring for preloading the other of the valve discs into a closed position.

2. Cooling system according to claim 1, wherein a bypass line is provided which bypasses the cooling device.

3. Cooling system according to claim 2, wherein the short circuit line branches off from the cooling circuit downstream of the pump and opens into the cooling circuit upstream of the pump.

4. Cooling system according to claim 2, wherein the valve device is a throttle device.

5. Cooling system according to claim 2, wherein the valve device is actuated by at least one of pneumatically and hydraulically.

6. Cooling system according to claim 2, wherein a thermostat with a thermostat valve device, is arranged in a junction region of the bypass line of the cooling circuit.

7. Cooling system according to claim 1 wherein the short circuit line branches off from the cooling circuit downstream of the pump and opens into the cooling circuit upstream of the pump.

8. Cooling system according to claim 7, wherein the valve device is a throttle device.

9. Cooling system according to claim 7, wherein the valve device is actuated by at least one of pneumatically and hydraulically.

10. Cooling system according to claim 7, wherein a thermostat with a thermostat valve device, is arranged in a junction region of a bypass line of the cooling circuit.

11. Cooling system according to claim 1 wherein the valve device is a throttle device.

12. Cooling system according to claim 11, wherein the valve device is actuated by at least one of pneumatically and hydraulically.

13. Cooling system according to claim 11, wherein a thermostat with a thermostat valve device, is arranged in a junction region of a bypass line of the cooling circuit.

14. Cooling system according to claim 1, wherein the valve device is actuated by at least one of pneumatically and hydraulically.

15. Cooling system according to claim 14, wherein a thermostat with a thermostat valve device, is arranged in a junction region of a bypass line of the cooling circuit.

16. Cooling system according to claim 1, wherein a thermostat with a valve device, is arranged in a junction region of a bypass line of the cooling circuit.

17. Cooling system according to claim 1, wherein the valve device is an annular slide valve.

18. Cooling system according to claim 1, wherein the valve device remains in its second position in an inactive state.

19. Cooling system according to claim 1, wherein the valve device is a proportional valve.

20. Cooling system according to claim 1, wherein the valve device is arranged upstream of the pump.

21. Cooling system according to claim 1, wherein one of the valve discs is configured in one-piece with the valve tappet, and the other of the valve discs is a separate component secured on the valve tappet in an axial direction by a securing element.

22. Cooling system according to claim 1, wherein the two valve discs are disposed on one end portion of the valve tappet and bear closely against a respective one of two valve seats when the valve discs are moved to a respective one of the first and second positions.

23. Cooling system according to claim 1, wherein the spring preloads the other of the valve discs against the valve seat ring.

* * * * *